US005107803A

United States Patent [19]

Furnivall

[11] Patent Number: 5,107,803

[45] Date of Patent: Apr. 28, 1992

[54] SPLIT-ACTION ROCKER ARM

[76] Inventor: Alan Furnivall, 23987 Fern Crescent, Maple Ridge, B.C.V2X 7E7, Canada

[21] Appl. No.: 656,422

[22] Filed: Feb. 15, 1991

[51] Int. Cl.[5] ..... F01L 1/12

[52] U.S. Cl. ..... 123/90.16; 123/90.39

[58] Field of Search ..... 123/90.12, 90.15, 90.16, 123/90.39

[56] References Cited

U.S. PATENT DOCUMENTS

| | | | |
|---|---|---|---|
| 4,452,188 | 6/1984 | Kosuda et al. | 123/90.39 |
| 4,475,489 | 10/1984 | Honda | 123/90.16 |
| 4,502,426 | 3/1985 | Skelley | 123/90.16 |
| 4,556,025 | 12/1985 | Morita | 123/90.16 |
| 4,708,101 | 11/1987 | Hara et al. | 123/90.16 |
| 4,724,802 | 2/1988 | Ishii | 123/90.16 |
| 4,726,332 | 2/1988 | Nishimura et al. | 123/90.16 |
| 4,759,321 | 7/1988 | Matsumoto et al. | 123/90.15 |
| 4,768,475 | 9/1988 | Ikemura | 123/90.16 |
| 4,887,562 | 12/1989 | Wakeman | 123/90.16 |
| 4,917,056 | 4/1990 | Yagi et al. | 123/90.16 |
| 4,942,853 | 7/1990 | Konno | 123/90.16 |

FOREIGN PATENT DOCUMENTS

| | | | |
|---|---|---|---|
| 44123 | 4/1979 | Japan | 123/90.16 |
| 114633 | 9/1979 | Japan | 123/90.16 |
| 168211 | 9/1984 | Japan | 123/90.16 |

*Primary Examiner*—E. Rollins Cross
*Assistant Examiner*—Weilun Lo

[57] ABSTRACT

A rocker arm mountable on an engine rocker shaft for transmitting the rotational motion of a cam on a camshaft into the linear motion of a valve lifter. The rocker arm includes a first cam engaging arm mountable on the rocker shaft for pivotal movement about the shaft. A second valve lifter engaging arm is provided that is also mountable on the rocker shaft for pivotal movement about the shaft. Both arms share a common pivoting axis when mounted on the rocker shaft. A coupling system is interposed between the first and second arms to adjust the relative pivotal positions of the arms with respect to each other on the rocker shaft in order to vary the overall rocker arm shape and to releasably lock the first and second arms together for movement as a single unit when following the cam.

19 Claims, 3 Drawing Sheets

SPLIT-ACTION ROCKER ARM

FIELD OF THE INVENTION

This invention relates to a rocker arm assembly for use in an internal combustion engine.

BACKGROUND OF THE INVENTION

The vast majority of engines in cars and trucks on the road today are internal combustion engines that employ a cam to open and close the inlet and exhaust valves of the engine. It is well known in the art of internal combustion engine design that whenever maximum power output at high RPM is desired, a high lift, rapid opening and closing cam profile is necessary, combined with a long overlap timing for the inlet and exhaust valves.

Conversely, when fuel economy and low emissions are the main concern then a very different cam profile is required having little lift, slow opening and closing and almost no overlap timing.

Most engines in everyday road use rely on a compromise valve timing that is the result of a fixed cam profile being used to cover the whole engine speed range. The results are moderate fuel economy, moderate emissions and moderate power output.

Prior art in the design of variable valve timing mechanisms have attempted to overcome the deficiencies of pre-set valve timing.

U.S. Pat. No. 4,942,853 to Konno and U.S. Pat. No. 4,726,332 to Nishimura disclose valve operating systems that employs a combination of low and high speed cam profiles that are engageable with sets of independent rocker arms through the operation of hydraulically actuated pins and dog clutches to vary the operation of the valves at specified engine speeds.

U.S. Pat. No. 4,887,562 to Wakeman discloses a self-contained hydraulic valve timing system that operates within a specially designed cylinder head. The hydraulic system is used to operate a solenoid valve to establish a lock between the cam and valve stem.

Further examples of variable valve mechanisms known to applicant include:

U.S. Pat. No. 4,708,101 to Hara
U.S. Pat. No. 4,475,489 to Honda
U.S. Pat. No. 4,502,426 to Skelley
U.S. Pat. No. 3,413,965 to Gavasso

SUMMARY OF THE INVENTION

The present invention provides a relatively simple rocker arm assembly that provides automatically variable valve timing and valve lift in order to provide good engine tractability and economy at low engine speeds and improved performance and fuel economy at high engine speeds.

The rocker arm assembly of the present invention uses a single high speed cam profile that acts on one part of a two part rocker arm. The two part rocker arm allows for a rocker arm motion that produces necessary changes in valve timing and lift to create a high volumetric efficiency and an increase in an engine's "brake mean effective pressure (BMEP).

Accordingly, the present invention provides a rocker arm mountable on an engine rocker shaft for transmitting the rotational motion of a cam on a camshaft into the linear motion of a valve lifter comprising:

a first cam engaging arm mountable on said rocker shaft for pivotal movement about said shaft;

a second valve lifter engaging arm mountable on said rocker shaft for pivotal movement about said shaft;

said arms sharing a common pivoting axis when mounted on said rocker shaft;

coupling means interposed between said first and second arms to adjust the relative pivotal positions of said arms with respect to each other on said rocker shaft in order to vary the overall rocker arm shape and to releasably lock said first and second arms together for movement as a single unit when following said cam.

It is intended that the rocker arm assembly of the present invention can be retro-fitted into most engines already in use in order to modify these engines for more efficient operation and power.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
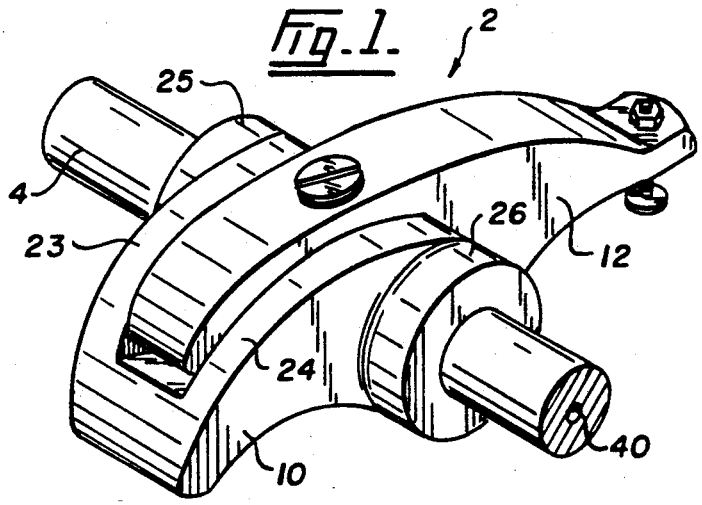
FIG. 1 shows a first embodiment of the rocker arm of the present invention.
Figure 2:
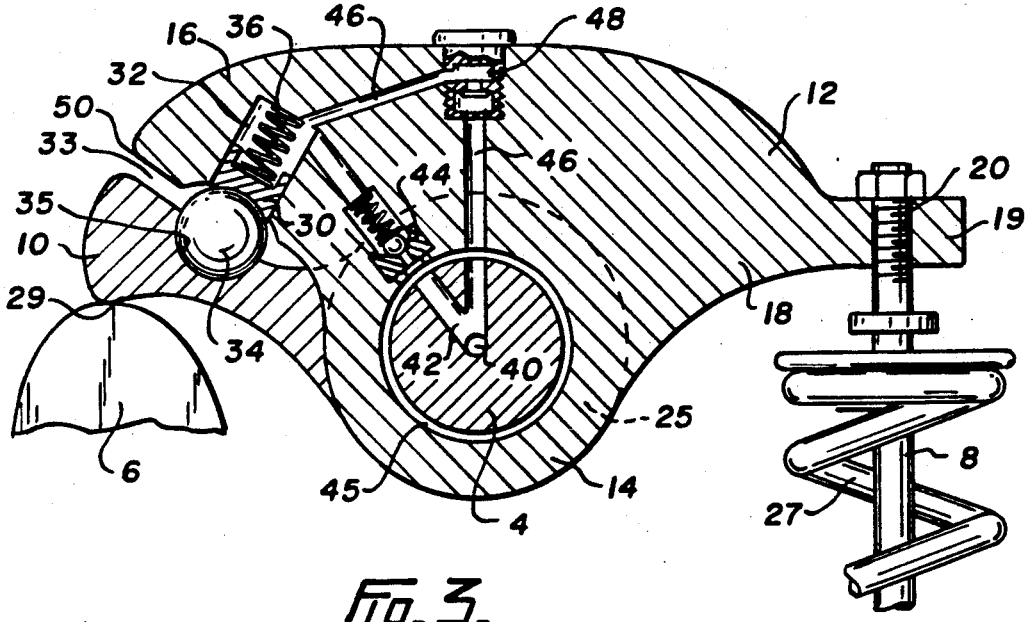
FIG. 2 is a section view through the rocker arm arrangement of FIG. 1.

FIGS. 1 and 2 illustrate a first embodiment of the present invention comprising a two-part rocker arm assembly mountable on an engine rocker shaft 4. Rocker arm 2 acts to transmit the rotational motion of cam 6 affixed to a camshaft (not shown) into the linear motion of valve lifter 8.

Rocker arm assembly 2 is comprised of two main parts: a first cam engaging arm 10 that is mountable on rocker shaft 4, and a second valve lifter engaging arm 12 also mountable on rocker shaft 4.

In the illustrated first embodiment, valve lifter engaging arm 12 comprises a central mounting member 14 adapted to sealably fit over rocker shaft 4. There is a first extension 16 that extends radially outwardly from the mounting member toward cam 6 (FIG. 2). A second extension 18 extends outwardly toward valve lifter 8. Extension 18 is provided with a flange 19 having an aperture 20 to accept the upper end of the valve lifter.

Cam engaging arm 10 comprises a bifurcated cam engaging member having parallel, spaced arms 23 and 24 that terminate in mounting members 25 and 26, respectively, adapted to fit about rocker shaft 4 on opposite sides of valve lifter engaging arm 12. The spaced, parallel arms define a central channel therebetween adapted to house first extension 16 of valve lifter engaging arm 12. This arrangement results in the two arms being mounted about a common axis defined by rocker shaft 14.

An important feature of the present invention is to control hydraulically the ability of the two arms of the rocker arm assembly to move independently of each other. In the present embodiment, both valve lifter engaging arm 12 and cam engaging arm 10 are mounted for pivotable movement about shaft 4 and hence for relative movement with respect to each other.

Coupling means are interposed between the two arms of the rocker arm assembly to releasably lock the arms together for movement as a single unit when following the cam profile. In the present embodiment, the coupling means includes an extendable member in the form of a piston 30 interposed between the two arms across gap 33. Piston 30 is housed in a cylinder 32 formed in the valve lifter engaging arm. Piston 30 engages against a ball bearing 34 seated in a socket 35 formed in the adjacent cam engaging arm 10 to provide an appropriate bearing surface to transfer the forces exerted by piston 30. A spring member 36 is provided in cylinder 32 to normally bias the piston outwardly of cylinder 32 against the force tending to close gap 33.

Figure 3:
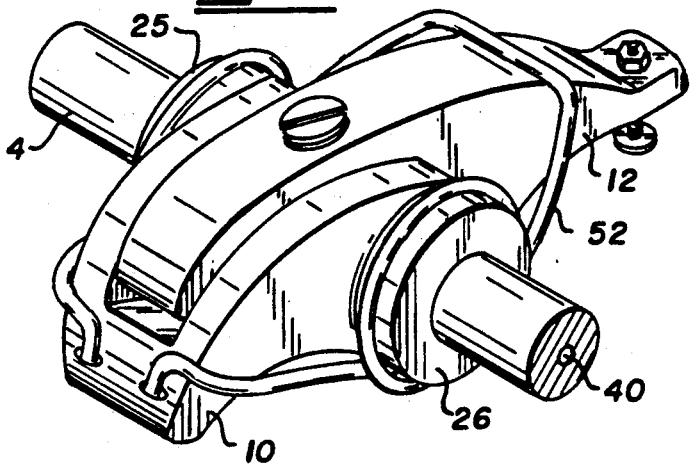
FIG. 3 shows a second embodiment of the present invention equipped with a cradle spring.

FIG. 3 illustrates a second embodiment of the present invention which is virtually identical to the embodiment of FIG. 1 except for the presence of biasing means comprising a coiled torsion spring 52 wrapped about the two arms so as to tend to bias the arms apart.

Actuating means are associated with piston 30 to extend and retract the piston as required for smooth engine operation. In the illustrated embodiment, actuating means are provided in the form of a hydraulic system. The hydraulic system includes a supply passage 40 communicating with an oil source. The supply passage can be conveniently located along the longitudinal axis of rocker shaft 4. Extending radially outwardly from supply passage 40 is a first passage 42 that communicates with cylinder 32 via a one-way valve 44. Ring seals 45 are provided about rocker shaft 4 to prevent leakage at the point where passage 42 intersects the outer surface of rocker shaft 4. Ring seals 45 define a annular chamber about the rocker shaft that communicates with the passage in the valve lifter engaging arm housing valve 44. One-way valve 44 is preferably a spring biased ball valve arranged to allow one-way oil flow from supply passage 40 to cylinder 32 when the oil pressure in the supply passage rises above an activating pressure determined by the spring of the ball valve.

A return passage 46 is provided that communicates cylinder 32 with supply passage 40 via pressure-relief valve 48. Return passage 46 is also sealed by seals 45 at the point where the passage leaves valve engaging arm 12 and enters rocker shaft 4. Pressure-relief valve 48 acts to allow oil to exit cylinder 32 only when the oil pressure in the supply passage drops below the pressure in the cylinder.

The oil and oil pressure to run the foregoing hydraulic system is preferably provided by the engine oil pump. Oil pressure can be controlled by a metering valve operating in response to engine RPM. Alternatively, oil pressure can be controlled using a multistage solenoid operating in response to electronic signals generated by an engine computer. It is also anticipated that oil pressure can be controlled by valve means associated with individual engine cylinders operating in response to engine induction vacuum.

Figure 5:
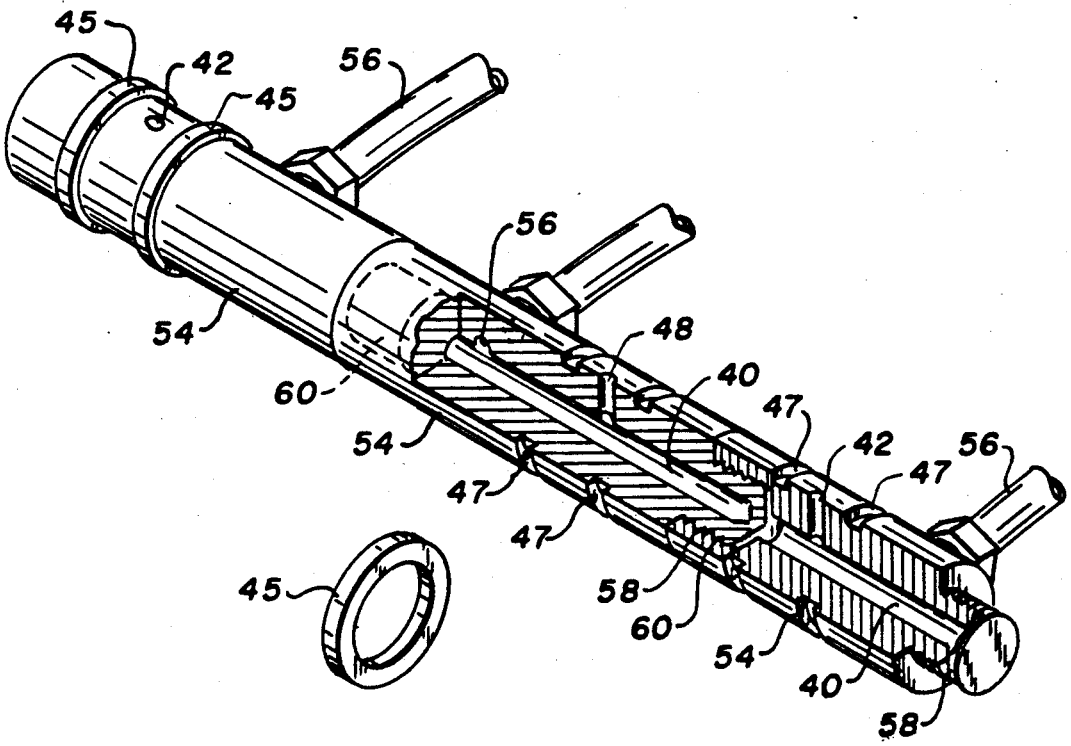
FIG. 5 is a perspective view with cut away sections showing the modified rocker shaft used with the various embodiment of the present invention having individual oil pressure passages to operate the rocker arm assemblies.

FIG. 5 illustrates a preferred construction for rocker shaft 4 for use with the rocker arm assembly of the present invention. Rocker shaft 4 is formed from a plurality of interconnectable shaft sections 54. Each shaft section has a male end 58 and a female end 60 that are appropriately threaded to allow adjacent shaft sections to be connected together to form an elongate rigid shaft. Each shaft section is designed to accommodate a single rocker arm assembly that operates a single valve lifter. Each shaft section has an inlet 56 that communicates with the previously described oil source. An axially aligned passage in each section serves as oil supply passage 40 and an outlet passage serves as first passage 42. It is important to note that each shaft section 54 has its own independent oil supply. Oil supply passage 40 of each section does not communicate with the supply passage of adjacent sections so that each rocker arm assembly is actuated in response to its own oil supply. Sealing channels 47 are formed on either side of radially extending passage 42 to accept ring seals 45 over which the pivotable arms of the rocker arm assembly are sealably mounted.

It is apparent that the rocker shaft construction illustrated in FIG. 5 allows for relatively simple assembly of multiple rocker arm units according to the present invention.

Figure 4:
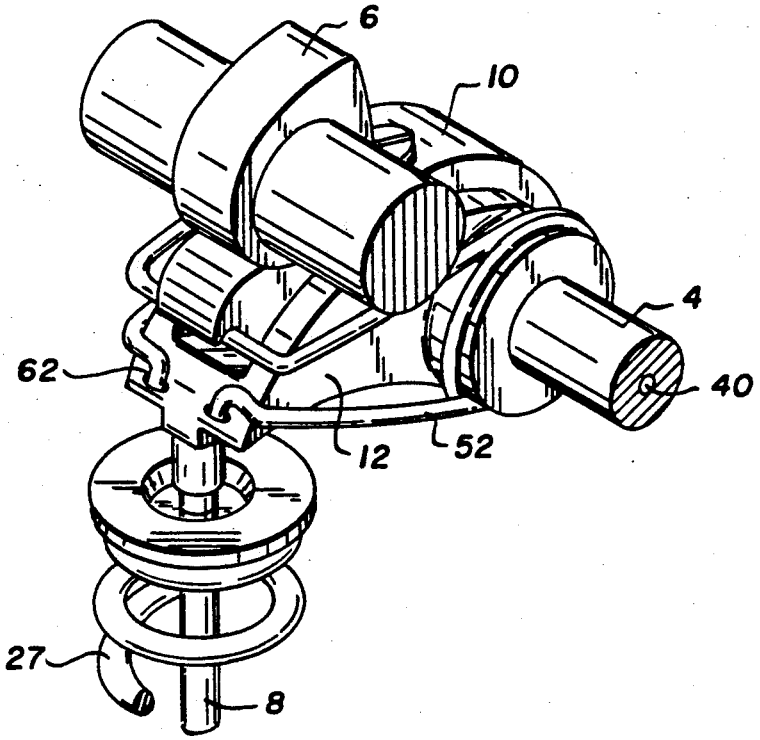
FIG. 4 shows a third embodiment of the present invention in which the cam is positioned over the rocker arm assembly.

FIG. 4 of the present invention illustrates an alternative rocker arm assembly for use in engines where the cam 6 is located over the valve lifter arm 8. In this embodiment, similar parts are numbered identically to the embodiment of FIG. 1. In this embodiment, cam engaging arm 10 comprises a centre arm pivotally mounted to rocker shaft 4 and having an upper surface in contact with cam 6. Cam engaging arm 10 also houses the coupling means of the rocker arm assembly which is identical to the coupling means illustrated in FIG. 2. Valve lifter engaging arm 12 comprises a bifurcated member having parallel, spaced arms joined at one end to provide a valve lifter engaging surface 62 and terminating at the opposite end in a pair of mounting members adapted to fit about the rocker shaft on opposite sides of the single cam engaging arm. In this particular embodiment, both arms 10 and 12 extend to the same side of the rocker shaft. In addition, a torsion spring 52 is provided in order to bias the two arms apart.

The various rocker arm arrangements of the present invention illustrated in FIGS. 1, 3 and 4 all function in a similar manner as detailed below:

Engine oil supplied by the engine oil pump passes through a metering valve that is controlled in one of the manners previously described. The pressurized oil is delivered to individual rocker arm shaft sections 54 for independent control of each rocker arm assembly.

At high engine speeds, engine oil is supplied to oil passage 40 at sufficiently high pressure to move past one-way valve 44 and enter cylinder 32. The oil pressure in cylinder 32 is less than the oil pressure in the oil passage with the result that pressure-relief valve 48 remains closed. Each time cam 6 rotates through that portion of its cycle in which the engine valve is closed (the rest period), spring 36 free to open the 33 between the arms allowing oil to flow into cylinder 32. At moderately fast engine speeds, torsion spring 52 is provided to assist in maintaining gap 33 during the rest period of cam 6.

As cam 6 rotates such that the cam lobe is brought into contact with cam engaging arm 10, gap 33 between the arms will tend to be forced closed and oil expelled from cylinder 32. One-way valve 44 will automatically close and the only route for oil to escape will be through return passage 46. However, as long as the oil pressure below pressure-relief valve 48 is greater than the pressure in passage 46, valve 48 will remain closed to maintain gap 33. As long as the oil pressure remains high, cylinder 32 will remain filled with oil and, effectively, cam engaging arm 10 and valve lifter engaging arm 12 will be separated by a gap 33. Effectively, the two arms are locked into their relative positions by the coupling means and the relative positioning of the two arms results in an overall rocker arm shape that increase valve lift and results in a longer opening period for the valves. Without changing the cam profile, the rocker arm of the present invention automatically creates the same effects as a high profile cam, but only at high engine speed when a high profile cam is desirable.

At lower engine speeds, the supplied oil pressure will fall. At a certain point, the pressure in supply line 40 will drop below the pressure in cylinder 32 allowing oil to exit from the cylinder through return passage 46 and pressure-relief valve 48 whenever the lobe of cam 6 contacts arm 10. Piston 30 will be forced into cylinder 32 and gap 33 will tend to close as cam engaging arm 10 rotates toward valve lifter engaging arm 12. Stop surface 50 on arm 12 limits the rotation of cam engaging arm 10 toward arm 12. The gap 33 which results at low engine speed creates an overall rocker arm shape that shortens the duration and extent of valve lift to a level appropriate for low engine speed to create the effect of a low profile cam.

Figure 6:
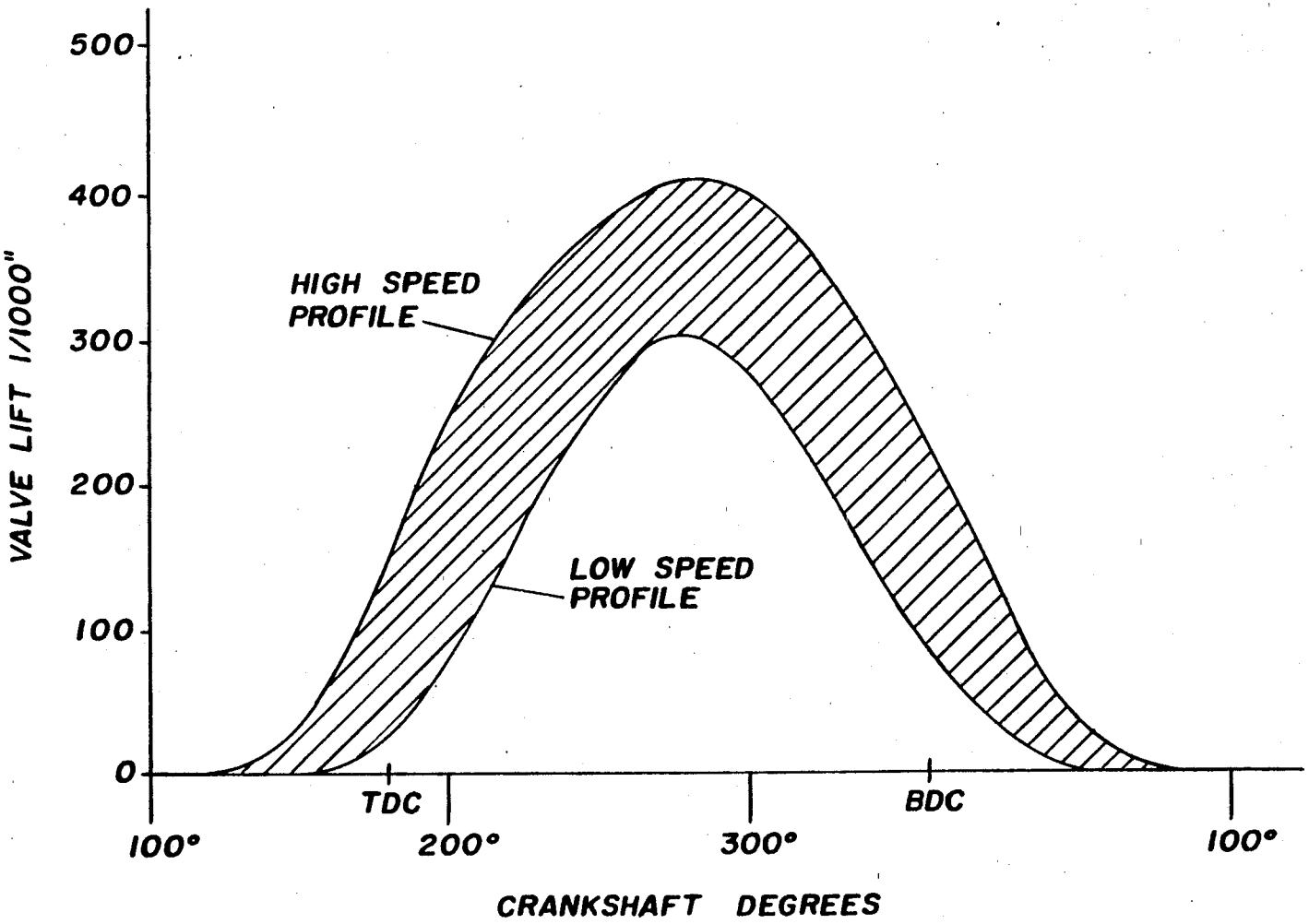
FIG. 6 is a graph showing the variation in valve timing and lift attainable with the rocker arm of the present invention.

FIG. 6 provides a graph showing a specific example of how the duration and extent of valve lift varies over a valve cycle between the high speed profile and the low speed profile of the rocker arm of the present invention. The shaded area represents a region in which the rocker arm can operate between the indicated low speed and high speed extremes. A feature of the present invention is the automatic infinite adjustability of the rocker arm between the low and high speed extremes in order to promote efficient operation of the engine. The arrangement of the present inventions uses a single cam system but enjoys the advantages of low and high profile cams at appropriate engine speeds.

An advantage of the rocker arm of the present invention is that it allows for relatively simple replacement of existing rocker arm assemblies operating between a cam and a valve lifter without major manufacturing modifications. The only modifications of note would be the installation of a segmented rocker shaft 4 as shown in FIG. 5 and appropriate modifications to direct oil to the supply passage.

Although the present invention has been described in some detail by way of example for purposes of clarity and understanding, it will be apparent that certain changes and modifications may be practised within the scope of the appended claims.

I claim:

1. An engine valve mechanism for use on an engine rocker shaft for transmitting the rotational motion of a cam on a camshaft into the linear motion of a valve lifter comprising:

a first cam engaging arm mountable on said rocker shaft for pivotal movement about said shaft;

a second valve lifter engaging arm mountable on said rocker shaft for pivotal movement about said shaft;

said arms sharing a common pivoting axis when mounted on said rocker shaft;

coupling means comprising an extendable member interposed between said first and second arms;

hydraulic actuating means associated with said extendable member to extend and retract said member whereby said arms are movable apart and together with respect to each other to adjust the relative pivotal positions of said arms with respect to each other on said rocker shaft in order to vary over a range of positions the overall rocker arm shape and to releasably lock said first and second arms together for movement as a single unit when following said cam.

2. An engine valve mechanism as claimed in claim 1 including biasing means interposed between said cam engaging arm and said valve lifter engaging arm adapted to bias said arms apart.

3. An engine valve mechanism as claimed in claim 1 in which said extendable member comprises a piston housed in a cylinder formed in one of said first and second arms.

4. An engine valve mechanism as claimed in claim 3 in which said piston engages a ball bearing in contact with the other of said first and second arms.

5. An engine valve mechanism as claimed in 4 in which said piston is normally biased outwardly of said housing cylinder.

6. An engine valve mechanism as claimed in claim 2 in which said biasing means comprises a torsion spring wrapped about said first and second arms to normally bias said arms apart.

7. An engine valve mechanism as claimed in claim 3 in which said hydraulic system comprises:

a supply passage communicating with an oil source;

a first passage communicating said supply passage with said cylinder housing and said extendable piston;

a one-way valve in said first passage to allow one-way oil flow from said supply passage to said cylinder when the oil pressure rises above an activating pressure;

a return passage communicating said cylinder with said supply passage; and a pressure-relief valve in said return passage to allow for oil to exit said cylinder when the oil pressure drops below the pressure in said cylinder.

8. An engine valve mechanism as claimed in claim 7 in which said supply passage is formed in said rocker shaft and extends along the longitudinal axis of said shaft.

9. An engine valve mechanism as claimed in claim 8 in which said first passage and return passage extend radially outwardly from said supply passage and one of said first and second arms, said one-way valve and said pressure relief valve being housed in the other of said first and second arms.

10. An engine valve mechanism as claimed in claim 9 including sealing means to seal said first and return passages at their intersection with said rocker shaft.

11. An engine valve mechanism as claimed in claim 7 in which said rocker shaft is formed from a plurality of interconnectable shaft sections, each shaft section having an inlet communicating with said oil source, an axially aligned passage that serves as said oil supply passage and an outlet passage that serves as said first passage, each section being adapted to accommodate a single rocker arm assembly.

12. An engine valve mechanism as claimed in claim 11 in which each shaft section has a male end and a female end that are threaded for engagement with a corresponding end of an adjacent shaft section in order to create a rocker shaft.

13. An engine valve mechanism as claimed in claim 11 in which each shaft section is provided with oil independently of other shaft sections.

14. An engine valve mechanism as claimed in claim 7 in which said oil pressure is provided by the engine oil pump.

15. An engine valve mechanism as claimed in claim 14 in which said oil pressure is controlled by a metering valve operating in response to engine RPM.

16. An engine valve mechanism as claimed in claim 14 in which said oil pressure is controlled by a multistage solenoid operating in response to electronic signals generated by an engine computer.

17. An engine valve mechanism as claimed in claim 14 in which said oil pressure is controlled by valve means associated with individual engine cylinders operating in response to engine induction vacuum.

18. An engine valve mechanism as claimed in claim 1 in which said valve lifter engaging arm comprises a central mounting member adapted to fit about said rocker shaft having a first extension housing said coupling means and a second extension adapted for attachment to said valve lifter, and said cam engaging arm comprises a bifurcated cam engaging member having parallel, spaced arms terminating in mounting members adapted to fit about said rocker shaft on opposite sides of said valve lifter engaging arm, said arms defining a channel therebetween adapted to accept said first extension of said valve lifter engaging arm such that said coupling means is positioned for engagement with said cam engaging member.

19. An engine valve mechanism as claimed in claim 1 in which said cam engaging arm comprises a central mounting member adapted to fit about said rocker shaft having an extension engageable by said cam and housing said coupling means, and said valve lifter engaging arm comprises a bifurcated member having parallel, spaced arms joined at one end to provide a valve lifter engaging surface and terminating at the opposite end in a pair of mounting members adapted to fit about said rocker shaft on opposite sides of said cam engaging arm, said parallel, spaced arms defining a channel therebetween adapted to accept said cam engaging arm such that said coupling means is positioned for engagement with said valve engaging arm.

* * * * *